US006366259B1

(12) United States Patent
Pruett et al.

(10) Patent No.: US 6,366,259 B1
(45) Date of Patent: Apr. 2, 2002

(54) ANTENNA STRUCTURE AND ASSOCIATED METHOD

(75) Inventors: James A. Pruett, Plano; James F. Kviatkofsky, Allen; Bill R. Norvell, Richardson; Charles M. Rhoads, Mckinney; Timothy E. Adams, Allen; Billy Powers, Jr., Richardson, all of TX (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/621,022

(22) Filed: Jul. 21, 2000

(51) Int. Cl.[7] ..... H01Q 21/10
(52) U.S. Cl. ..... 343/853; 343/767; 343/700 MS
(58) Field of Search ..... 343/853, 767, 343/770, 795, 844, 700 MS; 342/82, 89; H01Q 21/10

(56) References Cited

U.S. PATENT DOCUMENTS

| | | | | | |
|---|---|---|---|---|---|
| 4,291,312 | A | * | 9/1981 | Kaloi | 343/700 MS |
| 4,613,869 | A | | 9/1986 | Ajioka et al. | 343/768 |
| 5,041,835 | A | | 8/1991 | Matsumoto | 342/374 |
| 5,210,542 | A | | 5/1993 | Pett et al. | 343/700 |
| 5,309,163 | A | * | 5/1994 | Ngan et al. | 343/700 MS |
| 5,355,139 | A | | 10/1994 | Hirata et al. | 342/371 |
| 5,404,145 | A | * | 4/1995 | Sa et al. | 343/700 MS |
| 5,565,875 | A | * | 10/1996 | Buralli et al. | 343/700 MS |
| 5,903,239 | A | * | 5/1999 | Takahashi et al. | 343/700 MS |
| 5,933,121 | A | * | 8/1999 | Rainhart et al. | 343/873 |
| 6,023,243 | A | * | 2/2000 | Frank | 343/700 MS |
| 6,087,989 | A | * | 7/2000 | Song et al. | 343/700 MS |
| 6,154,176 | A | | 11/2000 | Fathy et al. | 343/700 |
| 6,169,513 | B1 | | 1/2001 | Cohen | 342/354 |
| 6,184,827 | B1 | | 2/2001 | Dendy et al. | 342/372 |
| 6,239,762 | B1 | * | 5/2001 | Lier | 343/770 |
| 6,239,764 | B1 | * | 5/2001 | Timofeev et al. | 343/795 |

* cited by examiner

*Primary Examiner*—Don Wong
*Assistant Examiner*—Trinh Vo Dinh
(74) *Attorney, Agent, or Firm*—O'Keefe, Egan & Peterman, LLP; René E. Grossman

(57) ABSTRACT

An antenna structure and associated method are disclosed that provides a lightweight and reduced-cost antenna element. The antenna structure may include a printed circuit board material coupled to a support structure. The printed circuit board may include electrical circuitry patterns and may have components mounted thereon to provide desired transmit and receive functionality, for example, to provide radio frequency transmit/receive functionality along with phase shifter and control circuitry. The support structure may be a light-weight material, for example, a space-qualified foam material that is strong and light-weight. The combined antenna structure of the present invention may thereby form a strong, rigid and light-weight antenna structure that may be used as sub-array elements in an antenna array, such as an ESA system.

37 Claims, 3 Drawing Sheets

ANTENNA STRUCTURE AND ASSOCIATED METHOD

TECHNICAL FIELD OF THE INVENTION

This invention relates generally to antenna assemblies that may be used to transmit and receive electro-magnetic radiation signals. More specifically, the invention relates to radio frequency (RF) antenna structures that may be used as sub-components, called subarrays, for electronically scanned arrays (ESAs) made up of a plurality of subarrays.

BACKGROUND

Electronically scanned arrays (ESAs) are made up of a plurality of antenna radiating elements or radiators, which together form a radiating surface. In one prior ESA implementation, each antenna subarray is configured with a plurality of radiators which are mounted on machined metal support structures. The radiators are located on precise and uniform spacings across the face of the antenna aperture. The radiators are connected to transmit and/or receive (T/R) components that are combined via an radio frequency (RF) distribution manifold. Phase shifters are provided to allow electronic steering of the antenna beam. Phase shifters may be a variety of devices, such as PIN diodes, MMIC's, ferrite phasors, or other phase shifting devices. Separate DC power and control signals are typically provided to the phase shifters or T/R components through distribution manifolds. A cooling manifold is also typically provided for dissipating heat generated by the phase shifter, T/R components, the DC and control manifold devices.

T/R components may be located immediately behind the ESA radiators to form an Active ESA (AESA). Alternatively, these T/R components may be located remote to the radiators to form a Passive ESA (PESA). Examples of RF generators in a PESA include traveling wave tube (TWT), magnetrons, or solid state transmitter (SST) components. In an AESA configuration, T/R components are usually located in hermetically sealed modules (T/R modules). RF losses are minimized in AESA configurations due to the close proximity of the T/R modules to the radiators. However, the requirement of having a discrete T/R module at each radiator site is costly. In a PESA configuration, the T/R components may be lumped together for more cost-efficient packaging because they are remote to the radiators. However, because these devices are remote from the radiators, increased RF losses tend to lower the overall system performance.

Although ESAs offer many advantages over mechanically scanned antennas, in many applications it is prohibitively expensive to substitute either AESA or PESA equipment for an equal performance mechanically scanned antenna. The most costly components of AESAs generally include the T/R modules and manifold structure required for the T/R modules. The most costly components of PESAs generally include the RF generator, phase shifters, distribution manifolding and structure required for the phase shifters. These problems reduce the cost competitiveness of ESAs compared to mechanically scanned antennas.

SUMMARY OF THE INVENTION

In accordance with the present invention, an antenna structure and associated method are disclosed that provide a lightweight and reduced cost subarray. The antenna structure of the present invention may be utilized as a subarray for an ESA system. The antenna structure may include a printed circuit board material coupled to a support structure. The printed circuit board may include electrical circuitry patterns and may have components mounted thereon to provide desired transmit and receive functionality, along with phase shifter and control circuitry. The support structure may be any support material, for example, a foam material that is both strong and lightweight. The combined antenna subarray structure of the present invention may thereby forms a strong, rigid and lightweight antenna component that may be used in an ESA system.

In one embodiment, the present invention is an antenna assembly, including a support structure having a surface and a circuit board coupled to the surface of the support structure, wherein the circuit board includes antenna circuitry. In further embodiments, the antenna circuitry includes electromagnetic radiation transmit and receive circuitry for radio frequency transmissions, and is lightweight material, such as expanded foam. Still further, the circuit board may have conductive structures that have been formed through a screen printing, etch or write process.

In another embodiment, the present invention is an antenna array, including a plurality of antenna assemblies, with each antenna assembly including a support structure and a circuit board coupled to the support structure, wherein the circuit board includes antenna circuitry and wherein the plurality of antenna assemblies communicate to provide an antenna array. In further embodiments, each antenna assembly further includes phase control circuitry that electrically adjusts a direction for transmission and receipt of electromagnetic radiation. Also, the connections for the phase control circuitry may be formed on the circuit boards through a screen printing, etch or write process.

In yet another embodiment, the present invention is a method for operating an antenna array, including transmitting and/or receiving electromagnetic radiation signals with a plurality of antenna assemblies, wherein each antenna assembly includes a support structure and a circuit board with antenna circuitry coupled to a surface of the support structure, and utilizing the signals received and/or transmitted by the antenna assemblies to form an array of transmitted and/or received signals. In a further embodiment, the present invention includes providing phase control circuitry that electrically adjusts a direction for the transmission or receipt of electromagnetic radiation.

Furthermore, the present invention is a radio frequency (RF)antenna assembly, including a substantially light weight support structure having first and second opposing support structure surfaces, a first circuit board having first and second opposing circuit board surfaces, wherein at least a portion of the second surface of the first circuit board is coupled to at least a portion of the first surface of the support structure, at least one of the first or second surfaces of the first circuit board having conductive RF transmission circuitry defined thereon, and at least one of the first or second surfaces of the first circuit board having conductive ground plane circuitry defined thereon. In this embodiment, the RF transmission circuitry and the ground plane circuitry are spaced in operative relationship to form at least one antenna radiating element, and the radiating element is coupled to at least a portion of the first or second surfaces of the first circuit board in operative relationship with the RF transmission circuitry and the conductive ground plane circuitry. In a more detailed respect, the RF antenna further includes a second circuit board having first and second opposing circuit board surfaces, wherein at least a portion of the second surface of the second circuit board being coupled to at least a portion of the support structure second surface, at least one of the first or second surfaces of the second circuit board having conductive RF transmission circuitry defined thereon, and at least one of the first or second surfaces of the second circuit board having conductive ground plane circuitry defined thereon In another embodiment, the present invention is an electronically scanned array, including a plurality of subarray elements, where each of the subarray elements includes a substantially lightweight support structure having first and second opposing support structure surfaces, a first circuit board having first and second opposing circuit board surfaces, and a second circuit board having first and second opposing circuit board surfaces. In this embodiment, the first circuit board has at least a portion of its second surface being coupled to at least a portion of the first surface of the support structure, its first surface having copper RF transmission circuitry, and its second surface having a copper ground plane circuitry defined thereon. The second circuit board has at least a portion of its second surface coupled to at least a portion of the second surface of the support structure surface, its first surface having copper RF transmission circuitry, and its second surface having copper ground plane circuitry defined thereon. In addition, the RF transmission circuitry and the ground plane circuitry for the first and second circuit boards are spaced in operative relationship to form first antenna radiating elements. Also, control and DC power circuitry are defined on the first surfaces of the first and second circuit boards. An RF T/R component is electronically coupled to each of the antenna radiating elements, where each of the T/R components includes at least one of a transmitting component, a receiving component, or a mixture thereof In a further embodiment, the RF antenna assembly includes a phase shifter element electronically coupled between each RF T/R component and one or more respective antenna radiating elements. Still further, the phase shifter may comprise at least one phase shifting element comprising a micro-electro-mechanical switch.

DESCRIPTION OF THE DRAWINGS

It is noted that the appended drawings illustrate only exemplary embodiments of the invention and are, therefore, not to be considered limiting of its scope, for the invention may admit to other equally effective embodiments.

DETAILED DESCRIPTION OF THE DRAWINGS

Figure 2:
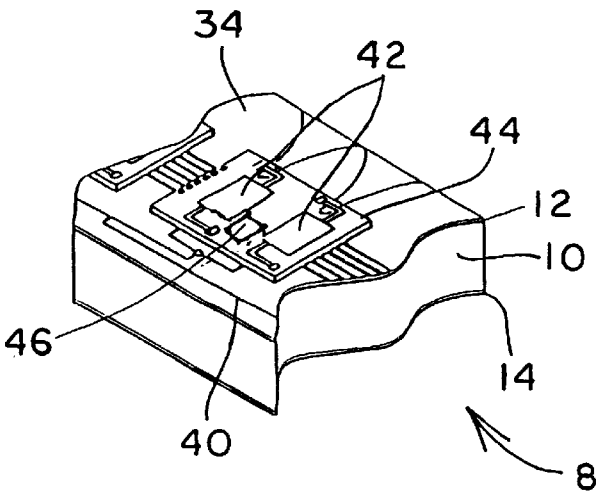
FIG. 2 is a partial perspective view of an antenna structure according to one embodiment of the disclosed method and apparatus.
Figure 1:
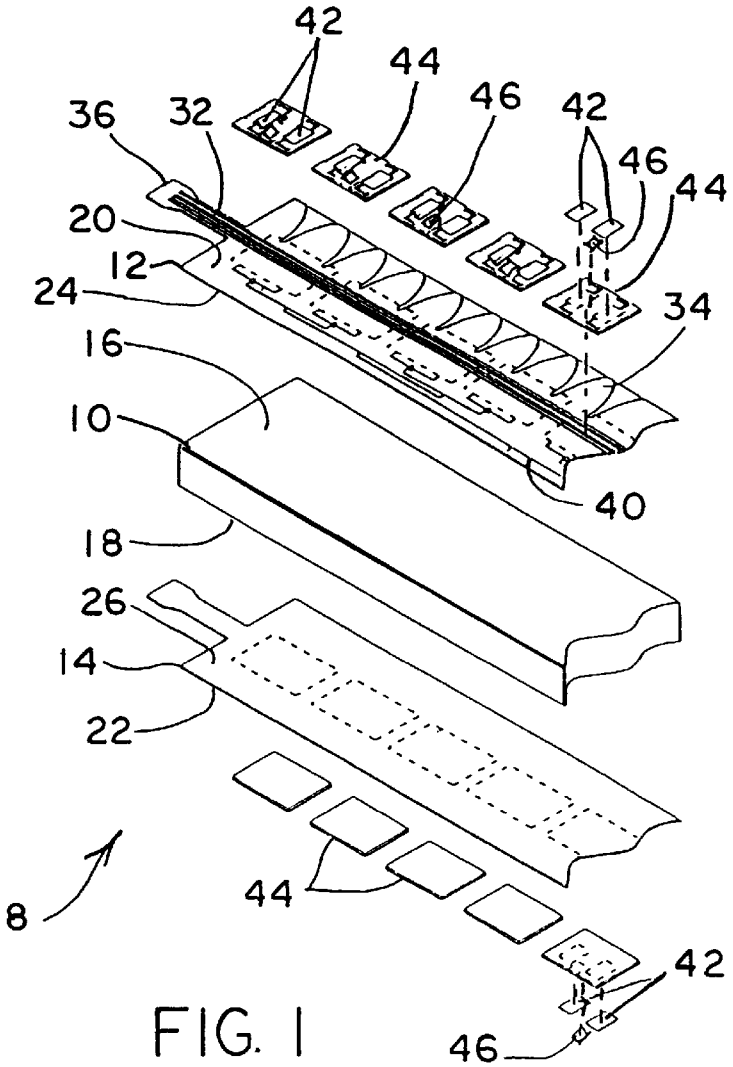
FIG. 1 is an exploded partial perspective view of an antenna structure according to one embodiment of the disclosed method and apparatus.

FIGS. 1 and 2 illustrate one exemplary embodiment of an radio frequency (RF) antenna assembly 8 according to the disclosed methods and apparatus. In FIGS. 1 and 2, antenna components are shown mounted or coupled to a substantially lightweight support structure 10. As used herein, "light-weight support structure" refers to a structure comprised of material, which is light in weight, or low in density, relative to support structure material used in conventional antenna arrays, such as aluminum or a metal composite. Examples of substantially lightweight support structure material include, but are not limited to, expanded foams, plastics, wood, fiberglass, composites, mixtures thereof, etc. Specific examples of substantially light weight support structure materials include, but are not limited to, foams such as Baltek Airex R82.80; plastics such as Ultem; a polyetherimide; woods such as Balsa; fiberglass such as Hexcell HRH-10 Aramid fiber and phenolic resin; etc. In one embodiment, substantially lightweight support structure may be "space qualified," meaning mechanical stability under widely changing pressures. Examples of space qualified foam include, but are not limited to, Baltek Airex R82.80 having a dielectric constant of about 1.1.

In the embodiment of FIGS. 1 and 2, support structure 10 may be rectangular and planar in shape, having dimensions of about 0.60 inches by about 3.30 inches by about 19.40 inches. However, with benefit of this disclosure, those of skill in the art will understand that a support structure may be configured in any shape or dimension known suitable for forming RF antenna assemblies, such as for use in ESAs. Examples of alternative shapes include, but are not limited to, conical, cylindrical, ellipsoidal, or spherical. Example of dimensions include, but are not limited to, 0.3 cm at 100 GHz to 3 m at 0.1 GHz.

As shown in FIGS. 1 and 2, first and second circuit boards 12 and 14 may be coupled to first and second sides 16 and 18 of support structure 10. "Coupled" is defined herein as including any method and/or materials suitable for directly or indirectly joining two or more materials, such as by using adhesives, fasteners, welding, hot bonding, pressure bonding, riveting, screwing, etc. In one embodiment, circuit boards 12 and 14 may be coupled directly to opposing first and second sides 16 and 18 of substantially lightweight support structure 10 using an adhesive, such as a high strength epoxy, etc. One specific example of such an adhesive is BF548 epoxy film available from Bryte Technologies, Inc. Although FIGS. 1 and 2 illustrate one embodiment in which first and second circuit boards are coupled to opposing sides of a support structure, it is possible in other embodiments that a circuit board be coupled to only one side of a support structure and/or that two or more circuit board sections may be coupled to a single side of a support structure, or that circuit boards 12 and 14 may be comprised from one circuit board that is formed around support structure 10.

First and second circuit boards 12 and 14 may comprise any circuit board substrate suitable to support and/or contain circuitry, such as RF transmission circuitry, control circuitry, power circuitry, ground plane circuitry, optical circuitry, antenna radiating circuitry, etc. With benefit of this disclosure, those of skill in the art will understand that circuit board materials, which may be employed, include circuit board materials known in the electronics art. Examples of suitable circuit board material types include, but are not limited to, materials such as fiberglass, polyamide, teflon-based materials, etc. Specific examples of circuit board material include, but are not limited to, "FR4" fiberglass composite available from Atlan Industries, "N4000-13" available from Nelco, Duroid available from Rogers, etc.

Circuit boards 12 and/or 14 may have any shape and/or dimension suitable for coupling to a support structure 10 to form an RF antenna assembly 8, and may or may not be co-extensive with support structure 10. In one embodiment, circuit board thickness may be from about 0.002 inches to about 0.045 inches, although thickness values outside this range are also possible. In the exemplary embodiment illustrated in FIGS. 1 and 2, circuit boards 12 and 14 may each have dimensions of about 0.002 inches by about 3.15 inches by about 19.22 inches, although other dimensions (including other thicknesses) may also be employed.

As illustrated and described elsewhere herein, various types of circuitry may be defined on first circuit board 12 and/or second circuit board 14. In this regard, circuitry may be defined using any method known in the art that is suitable for forming one or more layers of circuitry on a circuit board. In one embodiment circuitry is formed on both sides of a circuit board by simultaneously etching patterns that may be registered, that is aligned, to each other. The registration occurs by aligning the artwork patterns prior to photoetching the circuits.

Where more than one layer of circuitry is to be deposited on the same side of a circuit board, an underlying layer of circuitry (such as RF manifold circuitry) may be etched from copper laminate, and overlying circuitry (such as DC power/control circuitry) and the non-conductive layers may be screen printed or "written" utilizing a precision driven pen that dispenses the conductive circuitry features and non-conductive layers. Other types of conductive circuit material which may be employed includes any suitably conductive material for forming electronic circuitry. Examples include, but are not limited to, conductive metals, metal alloys, conductive inks, conductive epoxies, conductive elastomers, semiconductor material, etc. Besides copper, specific examples include, but are not limited to, copper alloys, aluminum, aluminum alloy, silver, gold, tin, tin/lead, mixtures thereof, etc.

In one embodiment, circuit board material that is pre-etched with circuitry may be coupled to one or both opposing sides of a support structure. For example, to form antenna elements on opposing sides of a support structure, a single piece of circuit board material suitably dimensioned to fold and cover the opposing side of the support structure may be coupled to the support structure. Two RF manifold circuitry patterns may then be etched on one and/or opposing sides of the circuit board. The circuit board may be folded and wrapped around and coupled to the support structure to form two subarrays per single support structure. This may be done by, for example, aligning the circuit board to the support structure via alignment features or tooling and then applying pressure to restrain the circuit board against the support structure during the cure cycle of the adhesive between the circuit board and the support structure.

In the embodiment illustrated in FIGS. 1 and 2, circuitry is illustrated defined on first sides 20 and 22 of respective circuit boards 12 and 14. Second sides 24 and 26 are shown in position for coupling to first and second sides 16 and 18 of support structure 10. In this embodiment, circuitry defined on first sides 20 and 22 of circuit boards 12 and 14 includes RF manifold circuitry 40, DC power/control circuitry 32, and RF radiating elements 34. With benefit of this disclosure, shape and dimension of radiating elements 34, as well as operative relationship between radiating element 34 and RF manifold circuitry 40, may be configured using methods known in the art.

Control circuitry connection structure 36 may be provided by appropriate shaping of circuit boards 12 and 14, and by formation of control circuitry 32 thereon, using methods described elsewhere herein. For example, control circuitry 32 lines may be etched, screen printed and/or written using methods described elsewhere herein.

Also illustrated in FIGS. 1 and 2 are phase shifters 42 mounted onto carriers 44. In this regard, any structure suitable for interfacing between the phase shifters 42 and the circuit boards 12 and 14 may be employed as a carrier. Examples include, but are not limited to, a BGA package custom made by MSC (Micro Substrate Corporation), etc. In one embodiment, carrier 44 may be a thin film network of low RF loss dielectric sheet. Carriers 44 may be electrically coupled to the underlying circuitry with, for example, wirebonds, ball grid arrays, gold ribbons, conductive epoxy, solder, conductive elastomer or other suitable electronic connection method. Phase shifters 42 may be any device suitable for shifting phase of an RF signal through digital and/or analog control signals and/or power. Examples of specific types of phase shifter devices include, but are not limited to, MEMS, PIN diodes, MMICs (monolithic microwave integrated circuits), or ferrite phasors, etc. In one embodiment, phase shifters may be micro-electromechanical switches, such as MEMS, available from Raytheon, HRL, MCC, Northrup-Grumman, etc. MEMS controllers 46 are shown mounted between phase shifters 42 on each carrier 44. Controllers 46 function to interpret phase command signals in to MEMS configuration settings, and may be any device suitable for interpreting phase command signals. Examples of suitable controller devices 46 include, but are not limited to, commercially available controllers such as "HV510", available from Super Tex.

Figure 3:
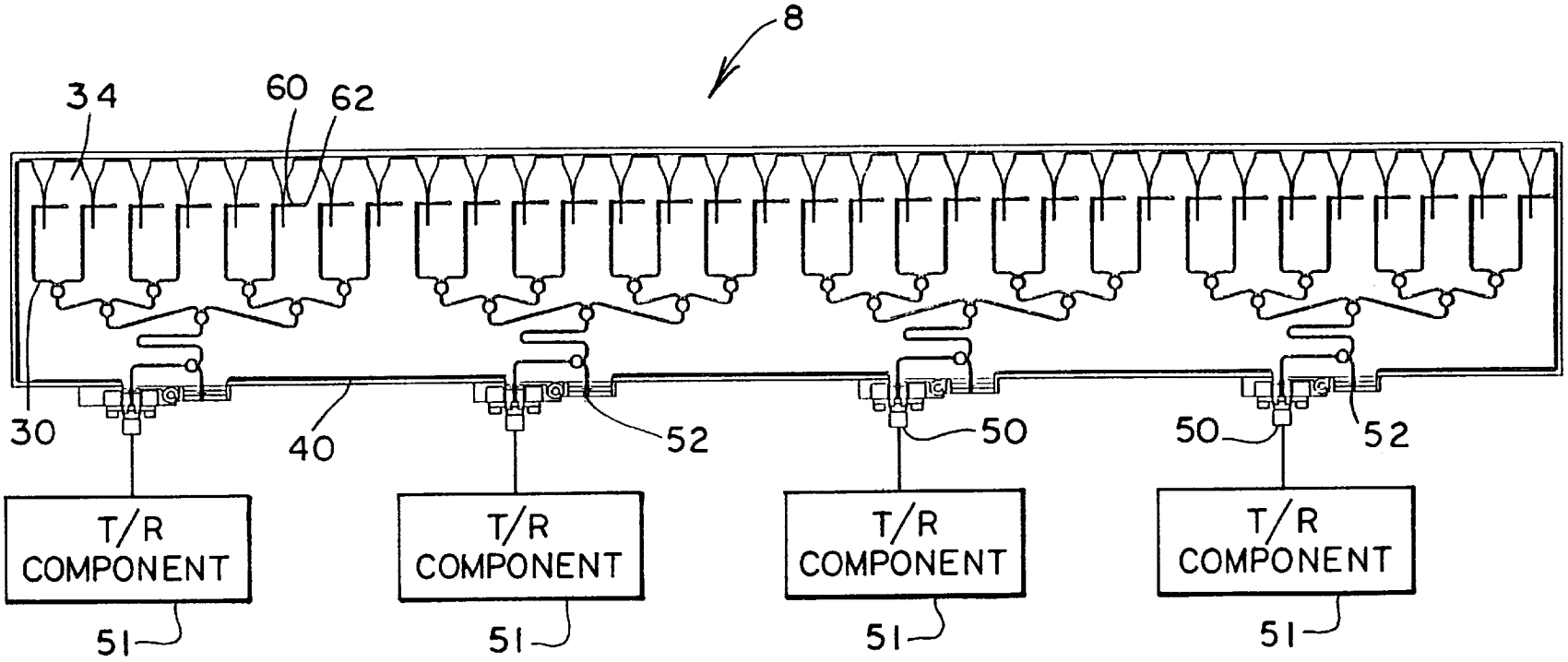
FIG. 3 is a simplified plan view of an antenna structure according to one embodiment of the disclosed method and apparatus.

FIG. 3 illustrates the various RF transmission lines 52 of the embodiment of FIGS. 1 and 2. Also illustrated in FIG. 3 are coaxial connectors 50 for the connection of RF manifold 40 to components such as RF transmit and/or receive (T/R) components 51. T/R components 51 may be configured and combined with antenna assemblies 8 to form ESA subarrays. In this regard, T/R components 51 may be located immediately behind antenna assembly 8 to form an active ESA, or may be located remote to assembly 8 to form a passive ESA. Examples of suitable RF generators that may be employed include, but are not limited to, traveling wave tube and solid state transmitter components. For AESA configurations, T/R components may be located in hermetically sealed T/R modules, such as F-22 Transmit/Receive Modules.

Figure 4:
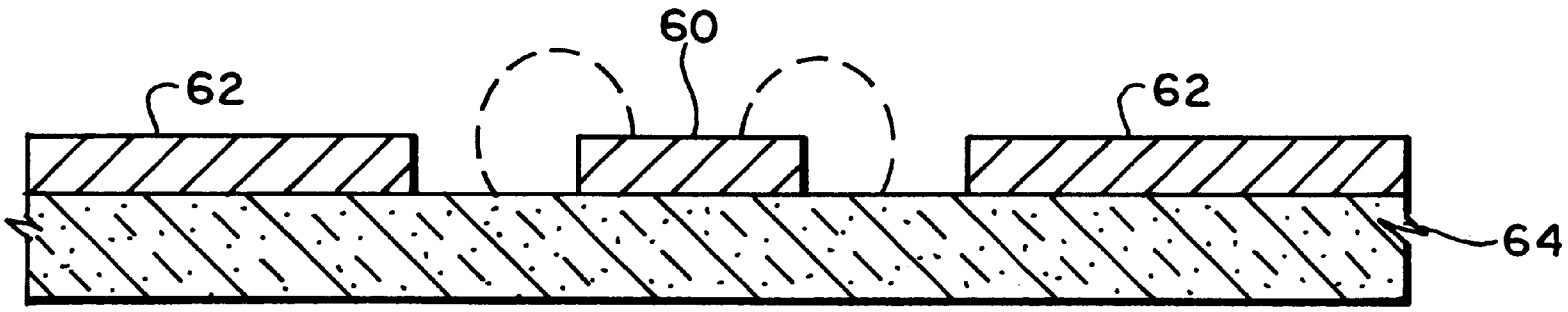
FIG. 4 is a simplified cross-sectional view of a RF transmission line on a circuit board according to one embodiment of the disclosed method and apparatus.
Figure 5:
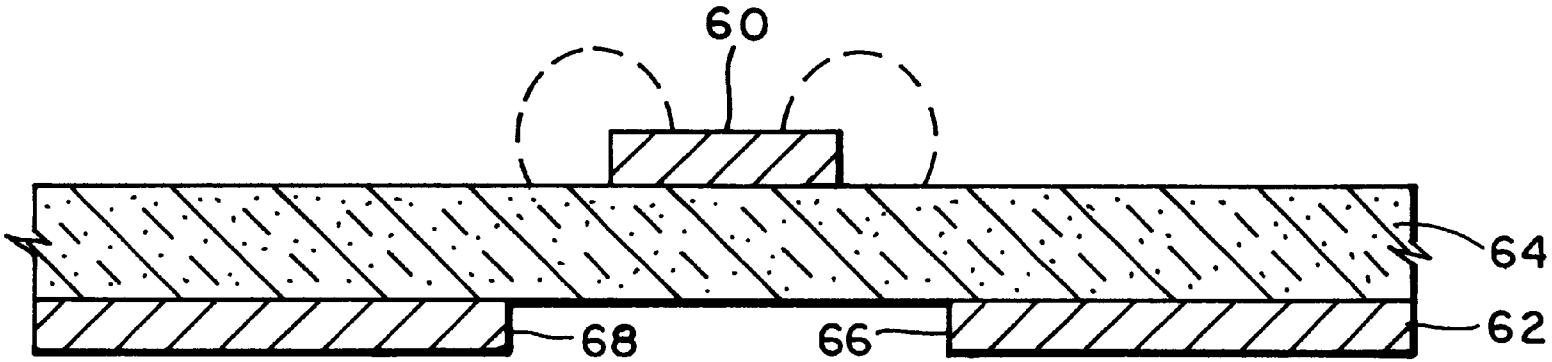
FIG. 5 is a simplified partial cross-sectional view of an alternative RF transmission line.

As previously described, various circuitry components may be defined in multiple insulated layers on a single side of a circuit board, and/or may be defined in varying combinations on opposing sides of a circuit board. In this regard, FIGS. 4 and 5 illustrate exemplary embodiments of RF transmission circuitry 60 and ground plane circuitry 62 as defined on circuit board 64. In one embodiment, circuitry 60 and 62 may exist as adjacently defined circuit traces on circuit board 64 (e.g., as circuitry 30 of FIG. 3) and electronically coupled to other components (e.g., coaxial connectors 50 of FIG. 3). FIG. 4 shows transmission circuitry 60 and ground plane circuitry 62 defined on the same side of board 64. In one such embodiment, a gap of about 0.0035 inches may exist between transmission circuitry 60 and ground plane circuitry 62. FIG. 5 illustrates transmission circuitry 60 and ground plane circuitry 62 on opposing sides of circuit board 64, having a thickness of about 0.002 inches. In such an embodiment, a horizontal gap of about 0.029 inches may exist between opposing sides 66 and 68 of ground plane circuitry 62.

Although electronically scanned arrays have been described and illustrated herein, it will be understood with benefit of this disclosure that other types of arrays (including mechanically scanned arrays), as well as other antenna configurations, may be manufactured using one or more of the features disclosed herein. Examples of such features which may be so employed include composite antenna assemblies having substantially lightweight support structures with at least one circuit board coupled to at least one side of each support structure.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed apparatus and compositions may be utilized in various combinations and/or independently. Thus the invention is not limited to only those combinations shown herein, but rather may include other combinations.

We claim:

1. An antenna assembly, comprising:

a support structure having first and second opposing surfaces;

a first circuit board coupled to the first surface of the support structure, the first circuit board comprising two opposing surfaces and including antenna circuitry defined on at least one of the two opposing circuit board surfaces, the antenna circuitry comprising ground plane circuitry; and a second circuit board coupled to the second surface of the support structure, the second circuit board comprising two opposing surfaces and including antenna circuitry defined on at least one of the two opposing circuit board surfaces, the antenna circuitry comprising ground plane circuitry.

2. The antenna assembly of claim 1, wherein the antenna circuitry includes electromagnetic radiation transmit and receive circuitry.

3. The antenna assembly of claim 2, wherein the electromagnetic transmit and receive circuitry is for radio frequency signals.

4. The antenna assembly of claim 3, wherein the antenna circuitry includes an antenna radiating element for the radio frequency signals.

5. The antenna assembly of claim 1, wherein the support structure is lightweight.

6. The antenna assembly of claim 5, wherein the support structure is a space-qualified expanded foam material.

7. The antenna assembly of claim 1, wherein the circuit board has conductive structures that have been formed through an etch process.

8. The antenna assembly of claim 1, wherein the circuit board has conductive structures that have been formed through a screen printing process.

9. The antenna assembly of claim 1, wherein the support structure comprises a foam material.

10. An antenna array, comprising:

a plurality of antenna assemblies, each comprising:

a support structure having first and second opposing surfaces;

a first circuit board coupled to the first surface of the support structure, the first circuit board comprising two opposing surfaces and including antenna circuitry defined on at least one of the two opposing circuit board surfaces, the antenna circuitry comprising ground plane circuitry; and a second circuit board coupled to the second surface of the support structure, the second circuit board comprising two opposing surfaces and including antenna circuitry defined on at least one of the two opposing circuit board surfaces, the antenna circuitry comprising ground plane circuitry;

wherein the plurality of antenna assemblies communicate to provide an antenna array.

11. The antenna array of claim 10, wherein each of the plurality of antenna assemblies includes electromagnetic radiation transmit and receive circuitry.

12. The antenna array of claim 11, wherein each antenna assembly further comprises phase control circuitry that electrically adjusts a direction for transmission and receipt of electromagnetic radiation.

13. The antenna array of claim 12, wherein the electromagnetic radiation is radio frequency signals.

14. The antenna array of claim 12, wherein the circuit board has conductive structures that have been formed through an etch process.

15. The antenna array of claim 12, wherein connections for the phase control circuitry have been formed on the circuit boards through a screen printing, etch, or write process.

16. The antenna array of claim 10, wherein the support structure comprises a foam material.

17. A method for operating an antenna array, comprising:

transmitting and/or receiving electromagnetic radiation signals with a plurality of antenna assemblies, each comprising a support structure having a first and second opposing surfaces, a first circuit board coupled to the first surface of the support structure and a second circuit board coupled to the second surface of the support structure, the first and second circuit boards each having two opposing surfaces and each having antenna circuitry defined on at least one of the two opposing circuit board surfaces, the antenna circuitry comprising ground plane circuitry; and utilizing the signals received and/or transmitted by the antenna assemblies to form an array of transmitted and/or received signals.

18. The method of claim 17, further comprising providing phase control circuitry that electrically adjusts a direction for the transmission or receipt of electromagnetic radiation.

19. The method of claim 18, wherein the electromagnetic radiation is radio frequency signals.

20. The method of claim 17, wherein the support structure comprises a foam material.

21. A radio frequency (RF) antenna assembly, comprising:

a substantially light weight support structure having first and second opposing support structure surfaces;

a first circuit board having first and second opposing circuit board surfaces, at least a portion of said second surface of said first circuit board being coupled to at least a portion of said first surface of said support structure, at least one of said first or second surfaces of said first circuit board having conductive RF transmission circuitry defined thereon, and at least one of said first or second surfaces of said first circuit board having conductive ground plane circuitry defined thereon, said RF transmission circuitry and said ground plane circuitry being spaced in operative relationship to form at least one antenna radiating element;

an antenna radiating element coupled to at least a portion of said first or second surfaces of said first circuit board in operative relationship with said RF transmission circuitry and said conductive ground plane circuitry; and a second circuit board having first and second opposing circuit board surfaces, at least a portion of said second surface of said second circuit board being coupled to at least a portion of said support structure second surface, at least one of said first or second surfaces of said second circuit board having conductive RF transmission circuitry defined thereon, and at least one of said first or second surfaces of said second circuit board having conductive ground plane circuitry defined thereon, said RF transmission circuitry and said ground plane circuitry being spaced in operative relationship to form at least one antenna radiating element.

22. The RF antenna assembly of claim 21, wherein said support structure and first circuit board are each substantially planar in shape.

23. The RF antenna assembly of claim 21, wherein said RF transmission circuitry and conductive ground plane circuitry are defined on the same surface of said first circuit board.

24. The RF antenna assembly of claim 21, wherein the support structure comprises a foam material.

25. The RF antenna assembly of claim 21 wherein said RF transmission circuitry and conductive ground plane circuitry are defined on opposing surfaces of said first circuit board, and wherein said antenna radiating element is coupled to said RF transmission circuitry.

26. The RF antenna assembly of claim 21, further comprising control and DC power circuitry defined on at least one of said first or second surfaces of said first circuit board.

27. The RF antenna assembly of claim 21, further comprising at least one RF transmit and/or receive (T/R) component electronically coupled to said antenna radiating element, said T/R component comprising at least one of a transmitting component, a receiving component, or a mixture thereof.

28. The RF antenna assembly of claim 27, wherein said at least one RF T/R component is positioned remote to said at least one antenna radiating element.

29. The RF antenna assembly of claim 27, wherein said at least one RF T/R component is positioned adjacent to said at least one antenna radiating element.

30. The RF antenna assembly of claim 27, further comprising at least one phase shifter element, said phase shifter element being electronically coupled between said at least one RF T/R component and said at least one antenna radiating element, said at least one phase shifting element comprising a micro-electro-mechanical switch.

31. An electronically scanned array, comprising:

a plurality of subarray elements, each of said subarray elements comprising:

a substantially lightweight support structure having first and second opposing support structure surfaces, a first circuit board having first and second opposing circuit board surfaces, at least a portion of said second surface of said first circuit board surface being coupled to at least a portion of said first surface of said support structure, said first surface of said first circuit board having copper RF transmission circuitry and said second surface of said first circuit board having copper ground plane circuitry defined thereon, said RF transmission circuitry and said ground plane circuitry being spaced in operative relationship to form first antenna radiating elements, a second circuit board having first and second opposing circuit board surfaces, at least a portion of said second surface of said second circuit board being coupled to at least a portion of said second surface of said support structure surface, said first surface of said second circuit board having copper RF transmission circuitry and said second surface of said second circuit board having copper ground plane circuitry defined thereon, said RF transmission circuitry and said ground plane circuitry being spaced in operative relationship to form second antenna radiating elements, control and DC power circuitry defined on said first surfaces of said first and second circuit boards, and an RF T/R component electronically coupled to each of said antenna radiating elements, each of said T/R components comprising at least one of a transmitting component, a receiving component, or a mixture thereof.

32. The electronically scanned array of claim 31, wherein each of said RF T/R components is positioned remote to said antenna radiating elements to form a passive electronically scanned array.

33. The electronically scanned array of claim 31, wherein each of said RF TIR components is positioned adjacent to said antenna radiating elements to form an active electronically scanned array.

34. The RF antenna assembly of claim 31, further comprising a phase shifter element electronically coupled between each RF T/R component and one or more respective antenna radiating element(s).

35. The RF antenna assembly of claim 31, wherein said phase shifter comprises at least one phase shifting element comprising a micro-electro-mechanical switch.

36. The RF antenna assembly of claim 35, wherein each of said micro-electro-mechanical switches is disposed on a phase shifter carrier, said phase shifter carriers being disposed on respective first sides of said first and second circuit boards.

37. The RF antenna assembly of claim 35, wherein said RF transmission circuitry is formed on said first and second circuit boards by deposition and etching of a copper layer on said first surface and ground plane circuitry is formed on said first and second circuit boards by deposition and etching of a copper layer on second surface of each of said respective first and second circuit boards; wherein said control and DC power circuitry is formed on said first surface of each of said respective first and second circuit boards by screening of at least one conductive layer and at least one non-conductive layer deposited above said copper layer after deposition and etching of said copper layer; and wherein said first and second antenna radiating elements are formed on said first and/or second surface of each of said respective first and second circuit boards by deposition and etching of a copper layer deposited on said first surface of each of said respective first and second circuit boards.

* * * * *

UNITED STATES PATENT AND TRADEMARK OFFICE

CERTIFICATE OF CORRECTION

PATENT NO. : 6,366,259 B1
DATED : April 2, 2002
INVENTOR(S) : James A. Pruett et al.

It is certified that error appears in the above-identified patent and that said Letters Patent is hereby corrected as shown below:

Column 10,
Line 28, please delete "TIR" and replace it with -- T/R --.

Signed and Sealed this

Fourth Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,366,259 B1
DATED : April 2, 2002
INVENTOR(S) : Pruett et al.

It is certified that error appears in the above-identified patent and that said Letters Patent is hereby corrected as shown below:

Column 10,
Lines 31, 35, 38 and 43, please delete "RF antenna assembly" and insert -- electronically scanned array --.

Signed and Sealed this

Ninth Day of November, 2004

JON W. DUDAS
*Director of the United States Patent and Trademark Office*